US005687856A

United States Patent [19]

Kendrena

[11] Patent Number: 5,687,856

[45] Date of Patent: Nov. 18, 1997

[54] TOOL AND IMPLEMENT HANGING SYSTEM

[76] Inventor: Ken Kendrena, 11124 Donnelly St., Rancho Cucamonga, Calif. 91701

[21] Appl. No.: 621,891

[22] Filed: Mar. 26, 1996

[51] Int. Cl.[6] ..... A47F 5/00

[52] U.S. Cl. ..... 211/70.6; 211/94; 211/65

[58] Field of Search ..... 211/70.6, 65, 66, 211/87, 94; 206/349

[56] References Cited

U.S. PATENT DOCUMENTS

| | | | |
|---|---|---|---|
| 429,421 | 6/1890 | Coit | 211/87 X |
| 1,575,270 | 3/1926 | Jankowsky | 211/87 |
| 2,754,974 | 7/1956 | Larson | 211/87 |
| 2,805,777 | 9/1957 | Larson | 211/87 X |
| 2,974,804 | 3/1961 | Maro | 211/70.6 |
| 3,285,426 | 11/1966 | Wilcke | 211/87 X |
| 3,411,633 | 11/1968 | Magnuson | 211/87 X |
| 3,515,284 | 6/1970 | Taylor | 211/60.1 |
| 4,094,415 | 6/1978 | Larson | 211/87 X |
| 4,318,486 | 3/1982 | Bobrowski | 211/87 |
| 4,480,755 | 11/1984 | Cartwright | 211/70.6 |
| 4,681,233 | 7/1987 | Roth | 211/87 X |
| 4,852,747 | 8/1989 | Breveglieri | 211/70.6 |
| 5,040,316 | 8/1991 | Fast | 248/909 X |
| 5,485,932 | 1/1996 | Romm et al. | 211/87 |

*Primary Examiner*—Robert W. Gibson, Jr.
*Attorney, Agent, or Firm*—Leo R. Carroll

[57] ABSTRACT

This invention consists of a family of related tool holders, each of which contain angulated shoe segments which permit sliding along the similarly angulated rails of a set of interconnected track modules. These track sets are interlocked to result in a track of arbitrary width, and may be fastened to various wall or stud surfaces. The individual tool holding members may be disposed along and locked to the tracks at spacings determined by the size of the implement being secured. In addition to the track module, the family of modules includes a hook module, a multiganged hook module, a J-hook module, a screw driver plate module, a tray module and a handle grabber module. This later module includes a unique spring loaded paddle wall for gripping round or non-round objects.

23 Claims, 10 Drawing Sheets

TOOL AND IMPLEMENT HANGING SYSTEM

BACKGROUND OF THE INVENTION

1. Technical Field

This invention relates generally to apparatus and methods for storing tools, and more particularly to a wall-mounted system for hanging tools, household items such as brooms and mops, gardening implements such as rakes and shovels, and other items such as sporting equipments.

2. Background Art

Many devices have been proposed for holding tools and keeping them in an orderly array. Most of these support the equipment being held in a vertical plane by either their implementing ends or by their handles. One type of the latter device relies on the weight of the tool to apply a frictional gripping force on a handle. An example of this approach is given in U.S. Pat. No. 4,905,951 to Putness which describes a disc-shaped flexible member having an aperture for resiliently gripping a tool handle.

Kanwischer, in U.S. Pat. No. 5,322,256, shows a device for holding tools between a pair of jaws which are arranged so that their downward movement also moves the jaws toward each other in a tool gripping position. U.S. Pat. No. 4,134,499 to Joswig describes a holder for long handled tools having two opposed side walls, one of which has a surface which slopes downwardly toward the other wall, and a gripping roller which is movable along the sloping surface for engaging the tool handle. The rear wall of this design has symmetrical vertical projecting flanges which are adapted for insertion into a C-shaped guide rail.

This invention consists of a family of related tool holders, each of which contain asymmetric angulated C-shaped shoe segments. The asymmetry of the angles of the top and bottom shoes permits both sliding along the angulated rails of a set of interconnected track modules, and snaping of the shoes on the track at any longitudinal position. These track sets are interlocked to result in an arbitrary width, and may be bolted or screwed to various wall or stud surfaces. The individual tool holding members may be disposed along and locked to the tracks at spacings determined by the size of the implement being secured.

In addition to the track module, the family of modules includes a hook module, a multiganged hook module, a J-hook module, a screw driver module, a tray module and a handle grabber module. This latter module includes a unique spring loaded paddle wall for gripping round or non-round objects.

The prime objective of this invention is to provide an improved tool and implement hanging system which is fully adjustable so as to removeably secure a wide variety of implement sizes to desired wall locations.

It is another object of this invention to provide an improved tool and implement hanging system using interlocking tracks.

It is yet another object of this invention to provide a improved tool and implement hanging system containing a spring loaded component for holding round or non-round shaft handles.

It is still another object of this invention to provide an improved tool and implement hanging system which may be inexpensively manufactured, is structurally rigid and safe, and can be easily installed by a homeowner.

The above and other objects, features and advantages of the present invention will become more apparent from the following description when making reference to the detailed description and to the accompanying sheets of drawings.

BRIEF DESCRIPTION OF THE DRAWINGS

FIG. 4 shows a front elevational view of a representation of a multiple ganged hook, an embodiment comprising a unitary assembly of hooks ganged together, while

FIG. 11(A) shows a side view of the engaged handle grabber module, while

DETAILED DESCRIPTION OF A PREFERRED EMBODIMENT

Figure 1:
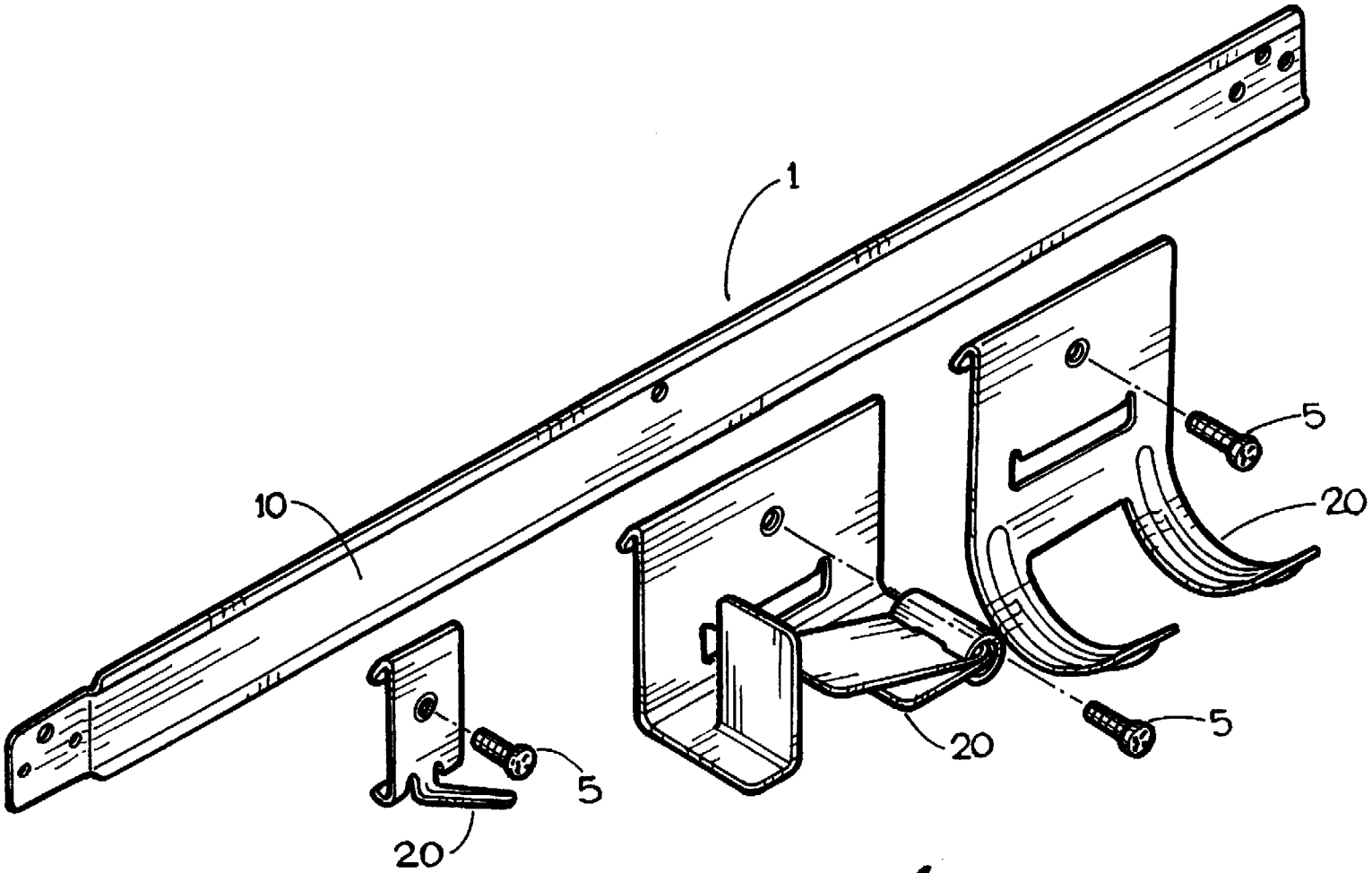
FIG. 1 shows an exploded isometric representation of the tool hanging system of this invention, including a track and three kinds of support modules.

FIG. 1 shows a representation of a tool hanging system 1 as a preferred embodiment of this invention. The system 1 generally comprises a track module 10 and a plurality of tool holding attachment modules 20. The track module 10 generally mounts with a back side to a wall or similar supporting structure. The attachment modules 20 fasten to the front side of the track module 10 and provide attachment support to specialized classes of tools and the like. After customized positioning of modules 20 along the track, each may be laterally retained by a locking device such as screw 5.

Figure 2A:
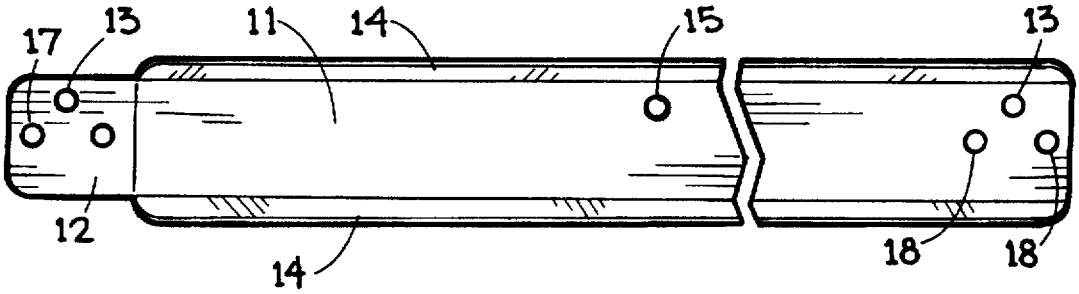
FIGS. 2(A), 2(B), and 2(C) show respectively a front elevational view, a bottom end view, and a side end view, of a representation of the track module.
Figure 2B:
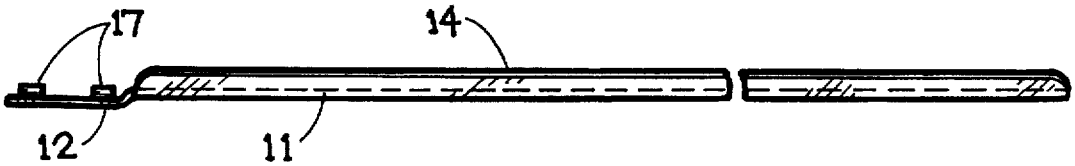
Figure 2C:
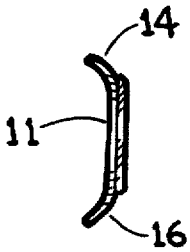

FIGS. 2(A), 2(B), and 2(C) show respectively a plan view, a front view, and a side view of a representation of the track module 10. A center brace 11 is a relatively flat, rectangular member extending the full length of the track module 10. At a first end a flange forms a mounting bracket 12 in a plane which is off-set from the plane of the center brace 11 substantially by its thickness. This provides clearance between the wall and the center brace 11 as is indicated in FIG. 2(B). A mounting hole 13 provides access for wall fastening means. Keys 17 are positioned on the mounting bracket 12 in line with a centerline through the center brace 11. These are circular protuberances raised substantially to the thickness of the center brace 11.

The second end of the center brace 11 does not have an offset flange. Another mounting hole 13 is placed to reflect a mirror image of the mounting hole 13 on the mounting bracket 12. Key holes 18 are placed to reflect a mirror image of keys 17. This provides adaption between two track modules 10 when two or more modules are combined in an extended length system. The mounting holes 13 may be spaced to accommodate stud centers which are typically spaced at 16 inches, in which case the length of the track module 10 consequently is approximately 80 inches. Support holes 15 may be spaced 8 inches from each end to provide for 24 inch stud centers as well. Two rails 14 run the length of the brace 11 and connect to each side. The rails 14 bend at track angles 16 toward the front of the track module 10 as shown in FIG. 2(C). The track angle 16 provides support in both vertical and outward direction relative to the wall. The exposed comers are rounded to easily accept attachment modules 20. The track module 10 may be manufactured from a single piece of material and may be formed by a simple stamping process. Corrosion resistant steel is a preferred material.

Figure 3B:
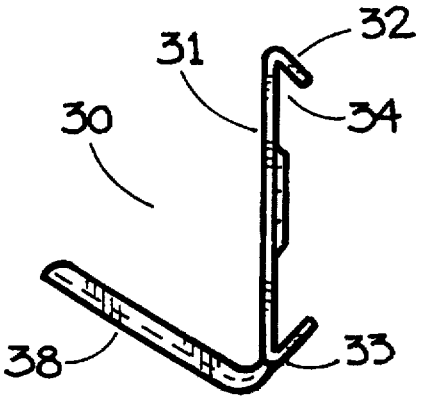
FIGS. 3(A), 3(B), and 3(C) are a rear elevational view of a segment of a multiple-hook, a side end view of the same segment, and a cross section view of FIG. C(A) as viewed at line A—A, respectively.
Figure 3A:
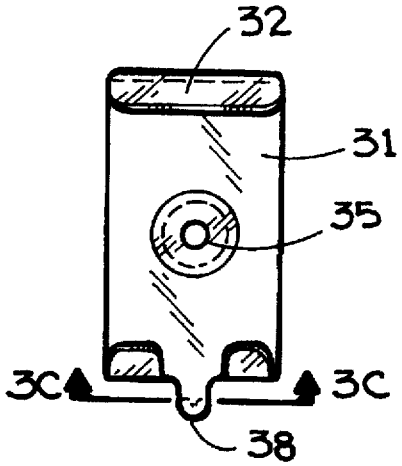

FIGS. 3(A) and 3(B) show respectively a plan view and a side view representation of a hook module 21. The module comprises a shoe segment 30, having a back side, and a hook segment 38 extending toward the front.

Figure 3C:
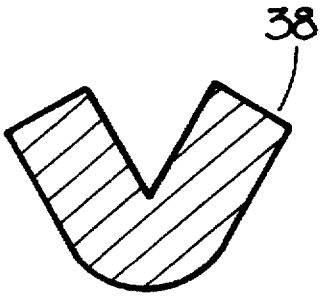

The shoe segment 30 comprises a flat, rectangular base plate 31. A top clamp 32 bends from the top of base plate 31 and a bottom clamp 33 bends from the bottom of the base plate 31. Both clamps bend toward the back and form shoe angles 34 that correspond to the track angles 16 of the track module 10. The clamps thus form a snap-on shoe, slidably interacting with the tracks 14 of the track module 10. The top clamp 32 is typically bent at about a 32 degree angle off normal and extends over the width of the base plate 31 to provide needed strength. The bottom clamp 33 is typically bent at about 45 degrees and may extend only partially over the width of the base plate 31 to allow placement of tool segments. In the case shown, the bottom clamp 33 of shoe segment 30 comprises two prongs on both sides of hook segment 38. Hole 35 provides support for a self-tapping sheet metal screw which is used as the locking mechanism for the base plate 31, and thereby the attachment modules 20, to the track module 10. The hook segment 38, see FIG. 3(B), extends from the base plate 31 forward. In order to obtain needed strength the segment may be rolled as is shown in FIG. 3(C), which depicts the cross section A—A in FIG. 3(A).

Figure 4:
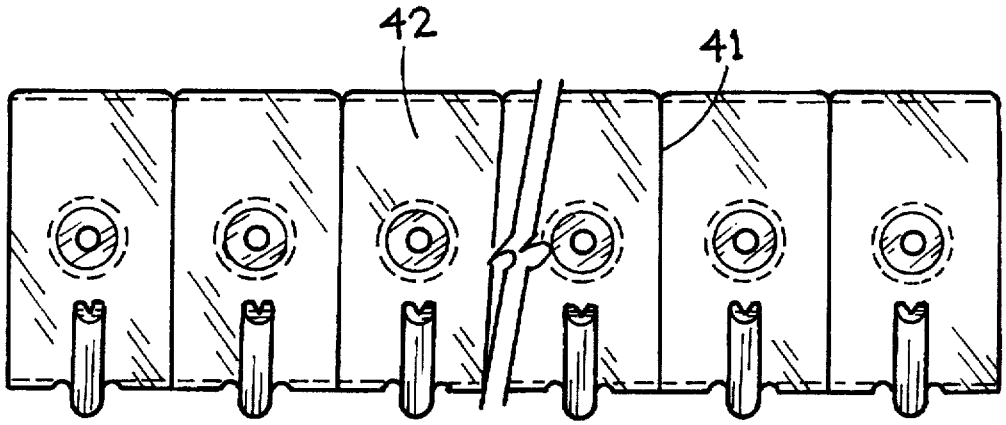
Figure 4A:
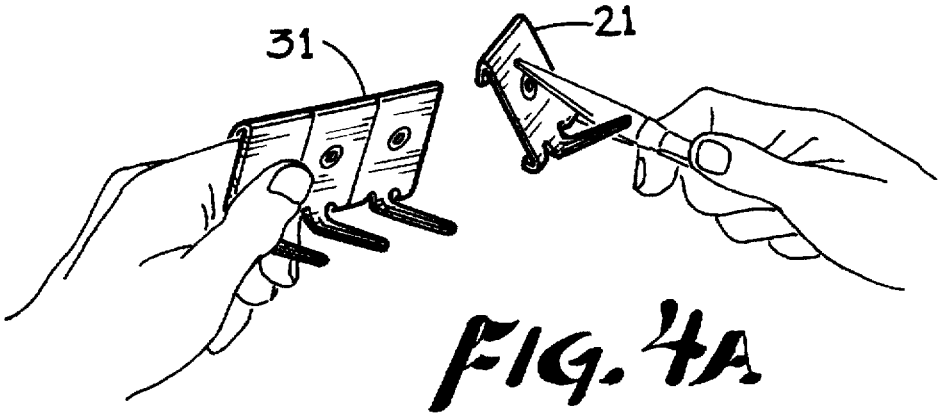
FIG. 4(A) depicts the removal of the single hook of FIG. 3 and its placement on the track in FIG. 4(B).

FIG. 4 shows a plan view of a multi-gang hook 40, an embodiment comprising a unitary assembly of hook modules 21 ganged together. The number of individual modules may be set at any manageable plurality, with the embodiment in FIG. 4 being comprised of six (6) individual units. The entire assembly of the preferred embodiment in FIG. 4 is fabricated from one piece of material centered about a unitary plate 42. Although many other materials may be used, corrosion resistant steel is preferred. The functionally distinct hook modules 21 are separated by scores 41 on both sides of the center base plate 31. This provides the ability to break the unitary plate 42 into pieces forming a desired plurality of individual hook modules 21 in smaller sets, as shown in FIG. 4(A). One such set for example, may include pairs of hook modules which are very useful in supporting pliers, open-ended wrenches, etc.

Figure 4B:
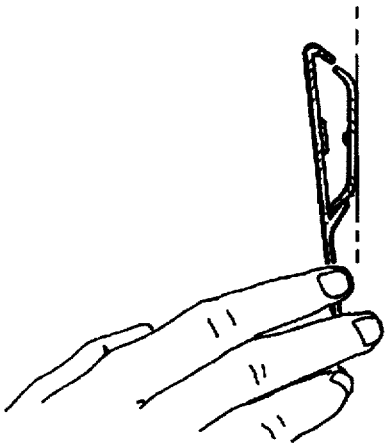

All the attachment modules contain the asymmetric angulated shoe segment 30 as described above, and will therefore not be repeated below. It should especially be noted that this difference in angles results in the ability to snap the modules onto the track, as shown in FIG. 4(B). This thereby provides the feature of being able to add or remove modules without disturbing the neighboring modules by having to slide them off the track.

Figure 5A:
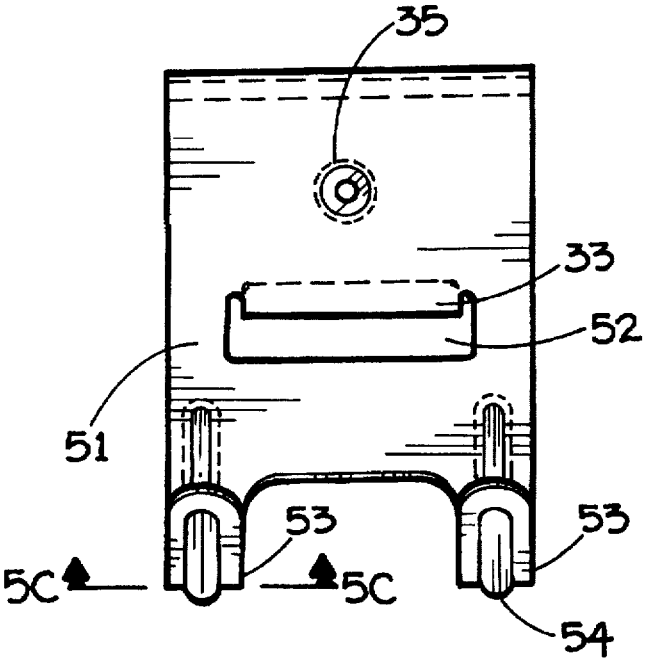
FIGS. 5(A) and 5(B) show front and side elevational views of a J-hook, respectively.
Figure 5B:
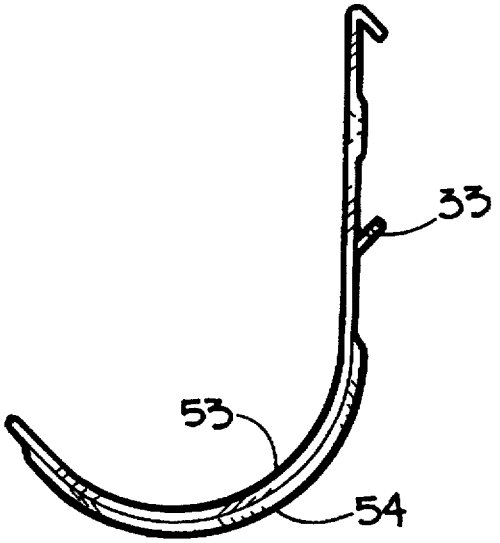
Figure 5C:
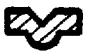
FIG. 5(C) shows a strengthening depression as viewed along line A—A in FIG. 5(A) further embodiment of an attachment module 20.

FIGS. 5(A) and 5(B) show a representation of a J-hook module 22 as a further embodiment of an attachment module 20. A back plate 51 forms the base of the module and includes the shoe segment 30. In this case the bottom clamp 33 is bent back from a portion of the back plate 51 leaving a cavity 52. Two arms extend from the bottom of the back plate 51 and are curved upward to form curved hooks 53. Hooks 53 are strengthened by depression 54, shown in FIG. 5(C) as a cross section along line A—A in FIG. 5(A).

Figure 6A:
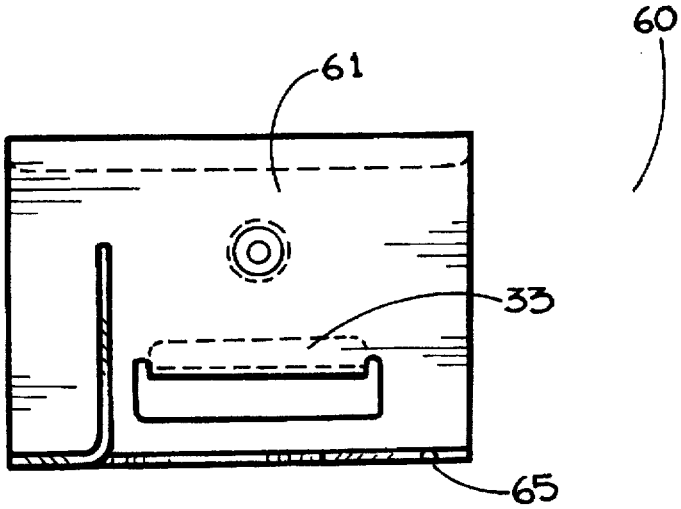
FIGS. 6(A), 6(B), and 6(C) show respectively—front, bottom, and side elevational views of of a representation of a handle grabber module.
Figure 6B:
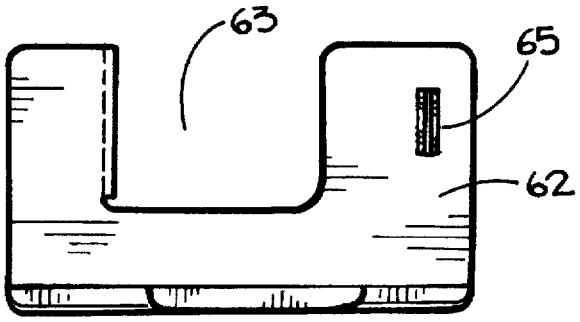
Figure 6C:
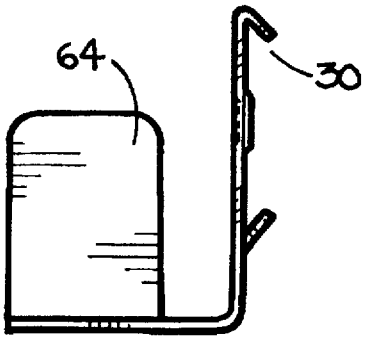

FIGS. 6(A), 6(B), and 6(C) show respectively a plan view, a front view, and a side view of a representation of handle grabber module 60, a further embodiment of the attachment modules 20. A back plate 61 includes a shoe segment 30 facing toward a back side. The bottom clamp 33 is formed as described relative to FIG. 5(A). A bottom plate 62 extends horizontally forward from the bottom of the back plate 61. The front of the bottom plate 62 includes an aperture 63 placed between a first and a second side of the bottom plate 62, so that the sides of the aperture 63 form two edges substantially normal to the back plate 61. A side plate 64 extends upward from the first side of bottom plate 62 adjacent to a first edge of aperture 63. A slot 65 extends through the bottom plate 62 near the second side of the bottom plate 62. The longer dimension of slot 65 is normal to the back plate 61, and the top opening of the slot 65 is smaller than the bottom opening.

Figure 9A:
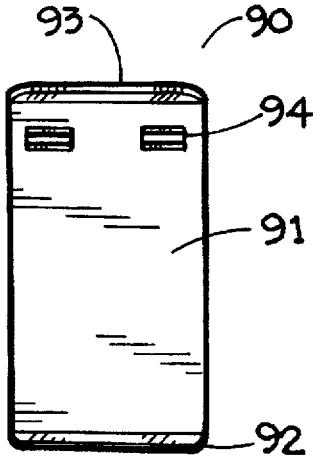
FIGS. 9(A), and 9(B) show respectively, front and side elevational views of a representation of the paddle.
Figure 9B:
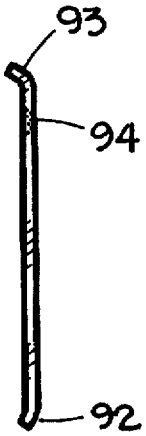
Figure 10A:
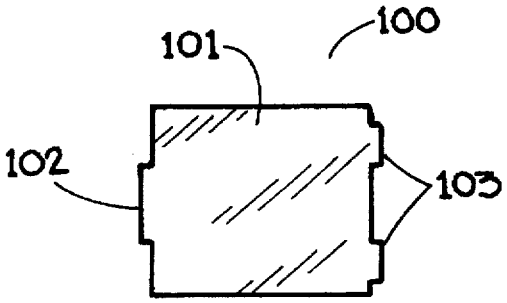
FIG. 10(A) shows a plan view of the spring blank prior to forming.
Figure 10B:
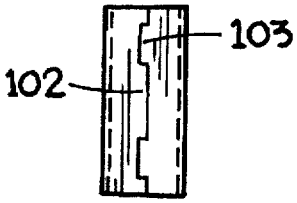
FIGS. 10(B), and FIG. 10(C) show side and end views of the spring after forming.
Figure 10C:
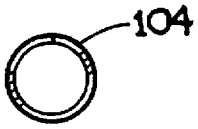

A spring loaded paddle 90 shown in FIG. 9, and a spring module 100 shown in FIG. 10 complete the handle grabber module 60. FIGS. 9(A) and 9(B) show plan and front view representations of the paddle 90. A rectangular base 91 has a rounded edge 92 on a first end and an upturned rocker 93 on a second end. Paddle slots 94 are punched through the base 91 near the second end and on each side of the base 91. FIG. 10(A), FIG. 10(B), and FIG. 10(C) show representations of the spring. FIG. 10(A) shows a flat blank 101 made of a spring material, preferably spring steel. The blank 101 has a tongue 102 on a first side and two prongs 103 on a second side; the spacing of the prongs 103 substantially brackets the tongue 102. The spring is rolled together so that the tongue 102 and the prongs 103 substantially meet, thus forming substantially a spring cylinder 104 as shown in a plan view in FIG. 10(B) and in an end view in FIG. 10(C).

When assembling, the spring module 100 is pried apart and slid over the second end of the handle grabber bottom plate 62 until the tongue 102 enters the slot 65 from below. The spring module 100 is thus anchored to the bottom plate 62. At this time the paddle module 90 is slidably inserted, rocker 93 first, between the bottom plate 62 and the prongs 103 of the spring module. When in place, the prongs 103 of the spring module enter the paddle slots 94 and pivotally anchor the paddle base 91 to the bottom plate of the handle grabber module.

Figure 11A:
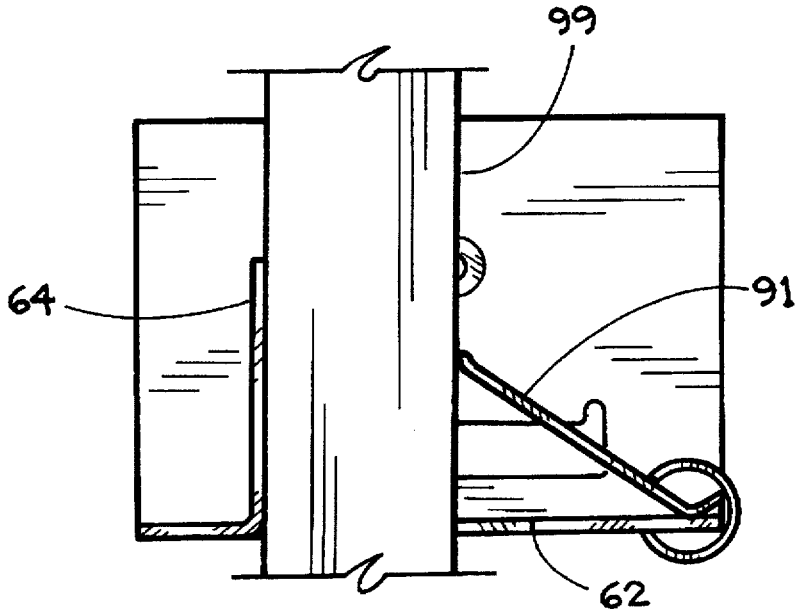
Figure 11B:
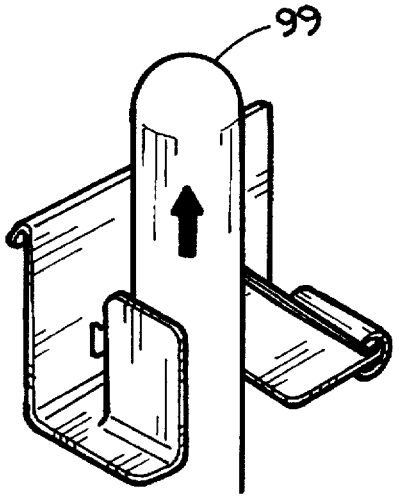
FIG. 11(B) and FIG. 11(C) present isometric views of the handle being inserted and removed.
Figure 11C:
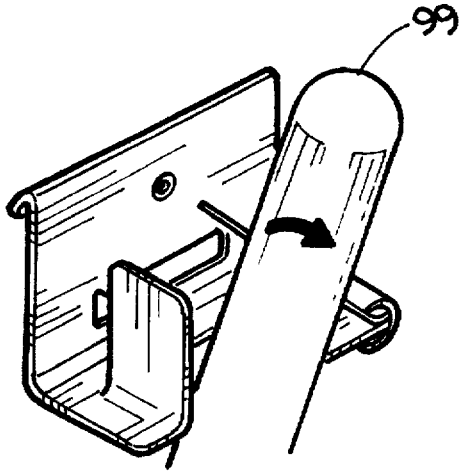

FIG. 11(A) shows a side sectional view of the module with tool handle 99 being held in place. FIG. 11(B) presents an isometric view of the handle being inserted from below into the aperture 63 of the handle grabber module 60. The tool handle 99 forces the paddle base 91 pivotally upwards about the rocker 93 held in the spring module 100. The spring loaded paddle base 91 thus catches and holds the tool handle in place. FIG. 11(C) shows the handle being removed by simply pulling it forward to release.

Although the work piece being inserted is shown as having a round handle, any other shape may be effectively supported.

Figure 7B:
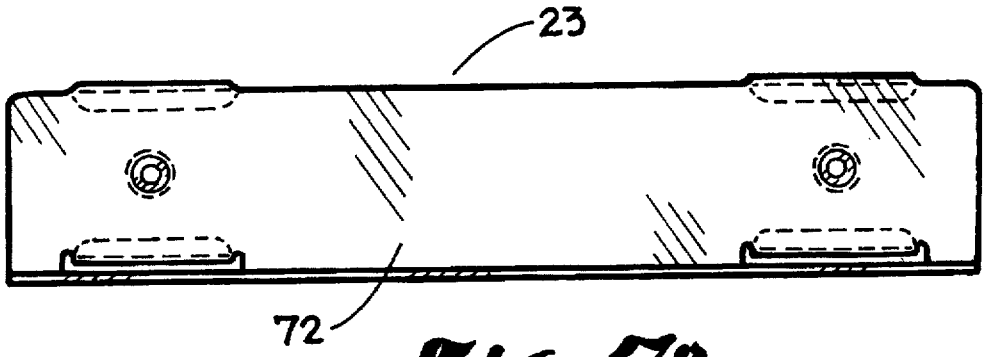
FIGS. 7(A), 7(B), and 7(C) show respectively, plan, front elevational and side elevational views of a representation of a screwdriver module.
Figure 7A:
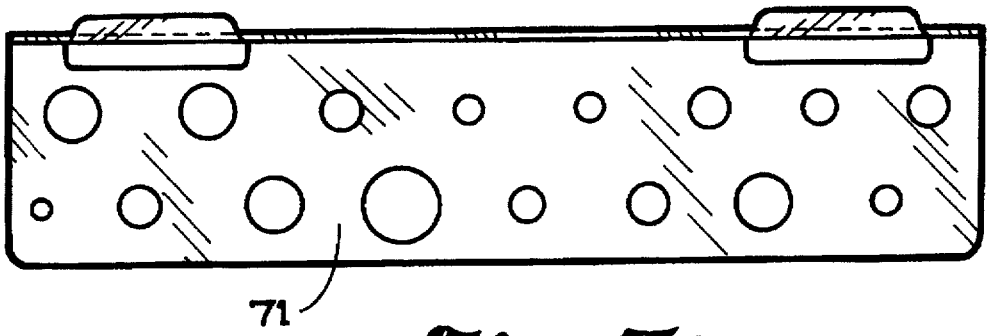
Figure 7C:
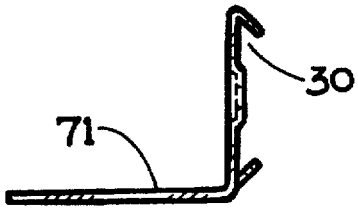

FIGS. 7(A), 7(B), and 7(C) show respectively a plan view, a front view, and a side view of a representation of screw driver module 23, which is a further embodiment of the attachment modules 20. A back board 72 includes the shoe segment 30 facing toward a back side. A platform 71 extends horizontally forward from the bottom of the back panel 72. A series of apertures are disposed on platform 71 so as to receive various sizes of screw drivers, or other elongated tools of variable width.

Figure 8A:
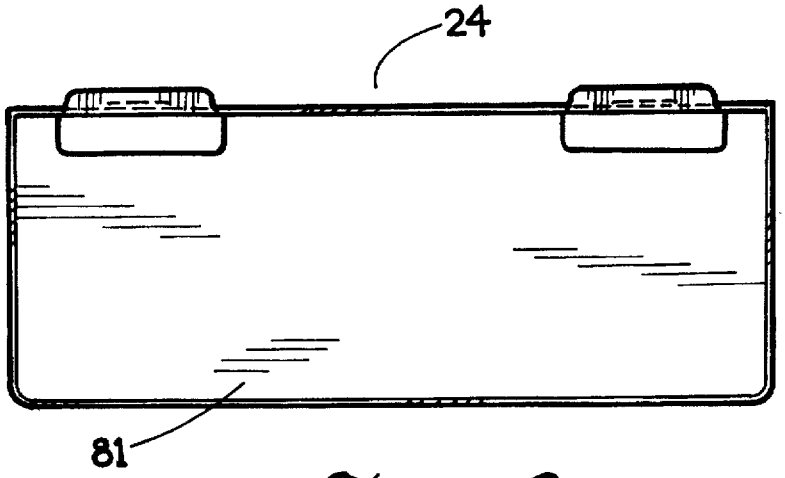
FIGS. 8(A), 8(B), and 8(C) show respectively, plan, front elevational and side elevational views of a representation of a tray module.
Figure 8B:
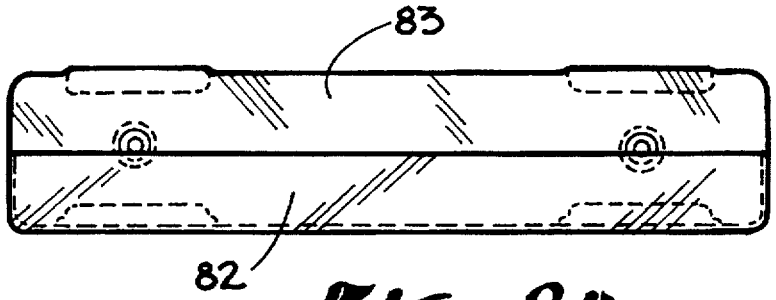
Figure 8C:
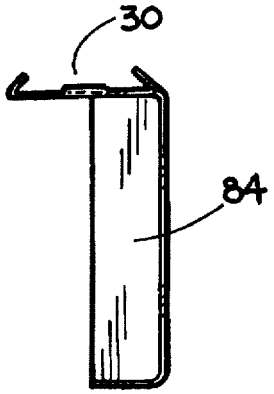

FIGS. 8(A), 8(B), and 8(C) show respectively a plan view, a front view, and a side view of a representation of tray module 24, another member of the family of attachment modules 20. A back panel 83 includes the shoe segment 30 facing toward a back side. A bottom panel 81 extends horizontally forward from the bottom of the back panel. Front panel 82 and side panels 84 rise at the edges of the bottom panel 62 forming a completed tray module 24. Although bottom panel 81 is indicated to be in a flat plane, it may of course be indented to support specific objects such as a coffee cup. Likewise, the tray may be compartmented to hold smaller objects such as common fasteners.

As with the other modules, the tray may be made of any material; however, the preferred embodiment is made from a single sheet of corrosion resistant steel and manufactured by inexpensive metal stamping processes.

The foregoing description and drawings were given for illustrative purposes only, it being understood that the invention is not limited to the embodiments disclosed, but is intended to embrace any and all equivalent alternatives, modifications and rearrangements of elements falling within the scope of the invention as defined by the following claims.

What I claim is:

1. A hanging system for supporting tools and implements against a wall surface, comprising:

a plurality of track means attached to said wall surface, each said track means comprising a center body portion having bent top and bottom edges formed as rails and having first and second opposing end edges thereon, said first end edge being shaped to colinearily interlock with the said second end edge of the center body portion of an adjacent track means, and is positioned so as to provide a combined track means of selected length with continuous top and bottom rail edges;

fastening means to attach said track means to said wall surface;

shoe segment means comprising a relatively flat base plate having front and back sides with bottom, top, and end edges, said top and bottom end edges being bent toward the back side in order to form top and bottom clamps having asymmetric angles relative to the back side of said base plate and which are disposed so as to normally snap around and loosely clamp said top and bottom rails on said track means for sliding said shoe segment along said rails; and a plurality of tool holding means for supporting specialized classes of tools, each said tool holding means having a back plate with said shoe segment mounted on the back side thereon and disposed so that said each tool holding means may be normally snap attached to said rail edges of said track means at any track position and slid to a desired position along said track means.

2. A hanging system as recited in claim 1, wherein said first end edge of said center body portion of the track means further comprises a first flat longitudinal flange, shaped to enter behind and colinearily interlock with the open said second end edge of the center body portion of an adjacent track means, said first flat longitudinal flange being positioned so as to extend from said first end edge in a plane behind and essentially parallel to the plane of said center body portion so as to space said center body portion away from said wall.

3. A hanging system as recited in claim 2, wherein said center body portion of said track means further comprises keyed protrusions on said first flat longitudinal flange extending normally away from said wall surface, and mating apertures on said opposing end thereon, for interlocking said track means with adjacent track means.

4. A hanging system as recited in claim 3, further comprising a locking device to secure said tool holding means to said track means at a selected position.

5. A hanging system as recited in claim 4, wherein said locking device is a screw fastener.

6. A hanging system as recited in claim 3, wherein said angular asymmetry between said top and bottom clamps is obtained by bending said bottom clamp to an angle which is greater than the angle to which the top clamp is bent.

7. A hanging system as recited in claim 6, wherein said angular asymmetry between said top and bottom clamps is obtained by bending said bottom clamp to an approximately 45 degree angle, and by bending said top clamp to an approximately 30 degree angle.

8. A hanging system as recited in claim 2, wherein said plurality of tool holding means comprises tray support means mounted on the front side of said tool holding back plate and disposed away from said wall surface.

9. A hanging system as recited in claim 2, wherein said plurality of tool holding means comprises horizontal plate support means mounted on the front side of said tool holding back plate, said plate support means having apertures formed thereon so as to vertically support tools of variable width away from said wall.

10. A hanging system as recited in claim 2, wherein said plurality of tool holding means comprises hook support means mounted on the front side of said tool holding back plate, said hook support means being angulated upward from a plane normal to said wall.

11. A hanging system as recited in claim 10, wherein said plurality of tool holding means comprises multiple hook support means mounted on the front side of said tool holding back plate, said multiple hook support means being angulated upward from a horizontal plane normal to said wall.

12. A hanging system as recited in claim 11, wherein said multiple hook support means includes scored partition means on the front side of said tool holding back plate for separating one or more hook support means from the remainder.

13. A hanging system as recited in claim 10, wherein said hook support means includes a J-shaped hook curved upward from a horizontal plane normal to said wall.

14. A hanging system as recited in claim 13, wherein said J-shaped hooks contain multiple tines curving upward from a horizontal plane normal to said wall.

15. A hanging system as recited in claim 2, wherein said plurality of tool holding means comprises handle grabbing means.

16. A hanging system as recited in claim 15, wherein said handle grabbing means comprises:

a bottom plate mounted on the front side of said tool holding back plate, said bottom plate extending from the bottom end of said tool holding back plate horizontally away from the wall, said bottom plate having a front aperture disposed between first and second side edges of said bottom plate, said aperture having first and second inside perimeters substantially parallel to said first and second side edges of said bottom plate, a back inside perimeter substantially parallel to the back edge of said bottom plate, and an open front perimeter;

a substantially vertical first side plate laterally positioned between the first and second side edges of said bottom plate and normal from the said tool holding back plate, said first side plate extending upward from the first side perimeter of the aperture;

a spring loaded paddle disposed at the second side edge of said bottom plate, said spring loading producing a rotational torque about an axis essentially parallel to said second side edge of said bottom plate, so that said torque maintains said paddle in a horizontal position partially covering said aperture, whereby spring opposing rotation caused by insertion of a tool handle into said aperture produces an increased paddle torque bearing on said tool handle so as to maintain said handle within said aperture; and spring means to produce said spring loading.

17. A kit for supporting tools and implements against a wall surface, comprising:

a plurality of track means for attachment to said wall surface, each said track means comprising a center body portion having bent top and bottom edges formed as rails and having first and second opposing end edges thereon, said first end edge being shaped to colinearily interlock with the said second end edge of the center body portion of an adjacent track means, both edges being positioned so as to provide a combined track means of selected length with continuous top and bottom rail edges;

fastening means to attach said track means to said wall surface;

shoe segment means comprising a relatively flat base plate having front and back sides with bottom, top, and end edges, said top and bottom end edges being bent toward the back side in order to form top and bottom clamps having asymmetric angles relative to the back side of said base plate and which are disposed so as to normally snap around and loosely clamp said top and bottom rails on said track means for sliding said shoe segment along said rails;

tray support means mounted on the front side of said tool holding back plate and disposed away from said wall surface, said tray support means having a back plate with said shoe segment mounted on the back side thereon and disposed so that said tray support means may be normally snap attached to said rail edges of said track means at any track position and slid to a desired position along said track means; and horizontal plate support means mounted on the front side of said tool holding back plate, and disposed away from said wall surface, said horizontal plate support means having apertures formed thereon so as to vertically support tools of variable width away from said wall, said horizontal plate support means having a back plate with said shoe segment mounted on the back side thereon and disposed so that said horizontal plate support means may be normally snap attached to said rail edges of said track means at any track position and slid to a desired position along said track means.

18. A kit for supporting tools and implements as recited in claim 17, further comprising;

multiple hook support means mounted on the front side of said tool holding back plate, and having one or more tines curving upward from a horizontal plane normal to said wall, said multiple hook support means including scored partition means on the front side of said tool holding back plate for separating one or more hook support means from the remainder, said multiple hook support means having a back plate with said shoe segment mounted on the back side thereon and disposed so that said multiple hook support means may be normally snap attached to said rail edges of said track means at any track position and slid to a desired position along said track means.

19. A kit for supporting tools and implements against a wall surface, comprising:

a plurality of track means for attachment to said wall surface, each said track means comprising a center body portion having bent top and bottom edges formed as rails and having first and second opposing end edges thereon, said first end edge being shaped to colinearily interlock with the said second end edge of the center body portion of an adjacent track means, and positioned so as to provide a combined track means of selected length with continuous top and bottom rail edges;

fastening means to attach said track means to said wall surface;

shoe segment means comprising a relatively flat base plate having front and back sides with bottom, top, and end edges, said top and bottom end edges being bent toward the back side in order to form top and bottom clamps having asymmetric angles relative to the back side of said base plate and which are disposed so as to normally snap around and loosely clamp said top and bottom rails on said track means for sliding said shoe segment along said rails; and handle grabbing means comprising:

a bottom plate mounted on the front side of said tool holding back plate, said bottom plate extending from the bottom end of said tool holding back plate horizontally away from the wall, said bottom plate having a front aperture disposed between first and second side edges of said bottom plate, said aperture having first and second inside perimeters substantially parallel to said first and second side edges of said bottom plate, a back inside perimeter substantially parallel to the back edge of said bottom plate, and an open front perimeter;

a substantially vertical first side plate laterally positioned between the first and second side edges of said bottom plate and normal from the said tool holding back plate, said first side plate extending upward from the first side perimeter of the aperture;

a spring loaded paddle disposed at the second side edge of said bottom plate, said spring loading producing a rotational torque about an axis essentially parallel to said second side edge of said bottom plate, so that said torque maintains said paddle in a horizontal position partially covering said aperture, whereby spring opposing rotation caused by insertion of a tool handle into said aperture produces an increased paddle torque bearing on said tool handle so as to maintain said handle within said aperture; and spring means to produce said spring loading.

20. A kit for supporting tools and implements as recited in claim 18, further comprising;

handle grabbing means comprising:

a bottom plate mounted on the front side of said tool holding back plate, said bottom plate extending from the bottom end of said tool holding back plate horizontally away from the wall, said bottom plate having a front aperture disposed between first and second side edges of said bottom plate, said aperture having first and second inside perimeters substantially parallel to said first and second side edges of said bottom plate, a back inside perimeter substantially parallel to the back edge of said bottom plate, and an open front perimeter;

a substantially vertical first side plate laterally positioned between the first and second side edges of said bottom plate and normal from the said tool holding back plate, said first side plate extending upward from the first side perimeter of the aperture;

a spring loaded paddle disposed at the second side edge of said bottom plate, said spring loading producing a rotational torque about an axis essentially parallel to said second side edge of said bottom plate, so that said torque maintains said paddle in a horizontal position partially covering said aperture, whereby spring opposing rotation caused by insertion of a tool handle into said aperture produces an increased paddle torque bearing on said tool handle so as to maintain said handle within said aperture; and spring means to produce said spring loading.

21. A hanging system for supporting tools and implements against a wall surface, comprising:

a plurality of track means attached to said wall surface, each said track means comprising a center body portion having bent top and bottom edges formed as rails and having first and second opposing end edges thereon, said first end edge of said center body portion of each said track means having a first flat longitudinal flange, shaped to enter behind and colinearily interlock with the open said second end edge of the center body portion of an adjacent track means, said first flat longitudinal flange being positioned so as to extend from said first end edge in a plane behind and essentially parallel to the plane of said center body portion so as to space said center body portion away from said wall, said first end edge being shaped to colinearily interlock with the said second end edge of the center body portion of an adjacent track means, and is positioned so as to provide a combined track means of selected length with continuous top and bottom rail edges;

fastening means to attach said track means to said wall surface;

shoe segment means comprising a relatively flat base plate having front and back sides with bottom, top, and end edges, said top and bottom end edges being bent toward the back side in order to form top and bottom clamps having asymmetric angles relative to the back side of said base plate and which are disposed so as to normally snap around and loosely clamp said top and bottom rails on said track means for sliding said shoe segment along said rails; and a plurality of tool holding means for supporting specialized classes of tools, each said tool holding means having a back plate with said shoe segment mounted on the back side thereon and disposed so that said each tool holding means may be normally snap attached to said rail edges of said track means at any track position and slid to a desired position along said track means, wherein said plurality of tool holding means comprises multiple hook support means mounted on the front side of said tool holding back plate, said multiple hook support means being angulated upward from a horizontal plane normal to said wall and including scored partition means on the front side of said tool holding back plate for separating one or more hook support means from the remainder.

22. A hanging system for supporting tools and implements against a wall surface, comprising:

a plurality of track means attached to said wall surface, each said track means comprising a center body portion having bent top and bottom edges formed as rails and having first and second opposing end edges thereon, said first end edge of said center body portion of each said track means having a first flat longitudinal flange, shaped to enter behind and colinearily interlock with the open said second end edge of the center body portion of an adjacent track means, said first flat longitudinal flange being positioned so as to extend from said first end edge in a plane behind and essentially parallel to the plane of said center body portion so as to space said center body portion away from said wall, said first end edge being shaped to colinearily interlock with the said second end edge of the center body portion of an adjacent track means, and is positioned so as to provide a combined track means of selected length with continuous top and bottom rail edges;

fastening means to attach said track means to said wall surface;

shoe segment means comprising a relatively flat base plate having front and back sides with bottom, top, and end edges, said top and bottom end edges being bent toward the back side in order to form top and bottom clamps having asymmetric angles relative to the back side of said base plate and which are disposed so as to normally snap around and loosely clamp said top and bottom rails on said track means for sliding said shoe segment along said rails; and a plurality of tool holding means for supporting specialized classes of tools, each said too 1 holding means having a back plate with said shoe segment mounted on the back side thereon an d disposed so that said each tool holding means may be normally snap attached to said rail edges of said track means at any track position and slid to a desired position along said track means, wherein said plurality of tool holding means includes handle grabbing means comprising:

a bottom plate mounted on the front side of said tool holding back plate, said bottom plate extending from the bottom end of said tool holding back plate horizontally a way from the wall, said bottom plate having a front aperture disposed between first and second side edges of said bottom plate, said aperture having first and second inside perimeters substantially parallel to said first and second side edges of said bottom plate, a back inside perimeter substantially parallel to the back edge of said bottom plate, and an open front perimeter;

a substantially vertical first side plate laterally positioned between the first and second side edges of said bottom plate and normal from the said tool holding back plate, said first side plate extending upward from the first side perimeter of the aperture;

a spring loaded paddle disposed at the second side edge of said bottom plate, said spring loading producing a rotational torque about an axis essentially parallel to said second side edge of said bottom plate, so that said torque maintains said paddle in a horizontal position partially covering said aperture, whereby spring opposing rotation caused by insertion of a tool handle into said aperture produces an increased paddle torque bearing on said tool handle so as to maintain said handle within said aperture; and spring means to produce said spring loading.

23. A kit for supporting tools and implements against a wall surface, comprising:

a plurality of track means for attachment to said wall surface, each said track means comprising a center body portion having bent top and bottom edges formed as rails and having first and second opposing end edges thereon, said first end edge being shaped to colinearily interlock with the said second end edge of the center body portion of an adjacent track means, both edges being positioned so as to provide a combined track means of selected length with continuous top and bottom rail edges;

fastening means to attach said track means to said wall surface;

shoe segment means comprising a relatively flat base plate having front and back sides with bottom, top, and end edges, said top and bottom end edges being bent toward the back side in order to form top and bottom clamps having asymmetric angles relative to the back side of said base plate and which are disposed so as to normally snap around and loosely clamp said top and bottom rails on said track means for sliding said shoe segment along said rails;

tray support means mounted on the front side of said tool holding back plate and disposed away from said wall surface, said tray support means having a back plate with said shoe segment mounted on the back side thereon and disposed so that said tray support means may be normally snap attached to said rail edges of said track means at any track position and slid to a desired position along said track means;

horizontal plate support means mounted on the front side of said tool holding back plate, and disposed away from said wall surface, said horizontal plate support means having apertures formed thereon so as to vertically support tools of variable width away from said wall, said horizontal plate support means having a back plate with said shoe segment mounted on the back side thereon and disposed so that said horizontal plate support means may be normally snap attached to said rail edges of said track means at any track position and slid to a desired position along said track means;

multiple hook support means mounted on the front side of said tool holding back plate, and having one or more tines curving upward from a horizontal plane normal to said wall, said multiple hook support means including scored partition means on the front side of said tool holding back plate for separating one or more hook support means from the remainder, said multiple hook support means having a back plate with said shoe segment mounted on the back side thereon and disposed so that said multiple hook support means may be normally snap attached to said rail edges of said track means at any track position and slid to a desired position along said track means, and handle grabbing means comprising:

a bottom plate mounted on the front side of said tool holding back plate, said bottom plate extending from the bottom end of said tool holding back plate horizontally away from the wall, said bottom plate having a front aperture disposed between first and second side edges of said bottom plate, said aperture having first and second inside perimeters substantially parallel to said first and second side edges of said bottom plate, a back inside perimeter substantially parallel to the back edge of said bottom plate, and an open front perimeter;

a substantially vertical first side plate laterally positioned between the first and second side edges of said bottom plate and normal from the said tool holding back plate, said first side plate extending upward from the first side perimeter of the aperture; a spring loaded paddle disposed at the second side edge of said bottom plate, said spring loading producing a rotational torque about an axis essentially parallel to said second side edge of said bottom plate, so that said torque maintains said paddle in a horizontal position partially covering said aperture, whereby spring opposing rotation caused by insertion of a tool handle into said aperture produces an increased paddle torque bearing on said tool handle so as to maintain said handle within said aperture; and spring means to produce said spring loading.

* * * * *